US012729539B2

(12) United States Patent
Campbell

(10) Patent No.: US 12,729,539 B2
(45) Date of Patent: Sep. 8, 2026

(54) VENTILATION BAFFLE SKIRT

(71) Applicant: WESCO DISTRIBUTION, INC., Pittsburgh, PA (US)

(72) Inventor: Joseph Clinton Campbell, Knoxville, TN (US)

(73) Assignee: WESCO Distribution, Inc., Pittsburgh, PA (US)

( * ) Notice: Subject to any disclaimer, the term of this patent is extended or adjusted under 35 U.S.C. 154(b) by 137 days.

(21) Appl. No.: 18/753,632

(22) Filed: Jun. 25, 2024

(65) Prior Publication Data

US 2025/0389121 A1 Dec. 25, 2025

(51) Int. Cl.
*E04D 13/17* (2006.01)
*E04D 13/152* (2006.01)

(52) U.S. Cl.
CPC ..... *E04D 13/178* (2013.01); *E04D 13/152* (2013.01)

(58) Field of Classification Search
CPC ..... F24F 7/02; E04D 12/008; E04D 13/1618; E04D 13/1625; E04D 13/1565; E04D 13/17; E04D 13/172; E04D 13/174; E04D 13/176; E04D 13/178; E04D 13/158; E04B 9/10; E04B 2001/2415; E04B 2001/2644; E06B 1/2608; E06B 1/2612
See application file for complete search history.

(56) References Cited

U.S. PATENT DOCUMENTS 3,160,987 A * 12/1964 Pinkley ..... E04D 13/152 52/95
3,240,144 A * 3/1966 Lind ..... E04D 13/178 454/260
3,863,553 A * 2/1975 Koontz ..... E04D 13/178 52/95
4,069,628 A * 1/1978 Kreimer ..... E04D 13/178 52/317
4,096,790 A * 6/1978 Curran ..... F24F 7/02 454/260
4,184,416 A * 1/1980 Koontz ..... E04D 13/178 52/95
4,185,433 A * 1/1980 Cantrell ..... E04D 13/178 52/94
4,189,878 A * 2/1980 Fitzgerald ..... F24F 7/04 52/95
4,223,489 A * 9/1980 Bentley ..... E04D 12/00 52/95

(Continued)

FOREIGN PATENT DOCUMENTS

GB 2272715 A * 5/1994 ..... E04D 12/008

*Primary Examiner* — Kyle J. Walraed-Sullivan
(74) *Attorney, Agent, or Firm* — K&L Gates LLP

(57) ABSTRACT

A ventilation baffle skirt for construction of a manufactured home has two or more truss slots separated by a regularly spaced interval, as well as a plurality of truss overhangs with each of the plurality of truss overhangs connected to one of the two or more truss slots. Each of the truss overhangs are connected to a corresponding one of the two or more truss slots at a top portion. The ventilation baffle skirt may have the regularly spaced interval equal to one half or one third of a distance between trusses a roof structure in a manufactured home. The ventilation baffle skirt may be used with a ventilation baffle to retain insulation material in an enclosed space while providing an air gap for air circulation in the area beneath a roof.

22 Claims, 8 Drawing Sheets

(56) References Cited

U.S. PATENT DOCUMENTS

| | | | | | |
|---|---|---|---|---|---|
| 4,581,861 | A * | 4/1986 | Eury | E04D 13/178 | 52/95 |
| 5,007,216 | A * | 4/1991 | Pearson | F24F 7/02 | 52/317 |
| 6,243,995 | B1 * | 6/2001 | Reeves | E04D 13/004 | 52/96 |
| 6,332,299 | B1 * | 12/2001 | Stewart, III | E04C 3/292 | 52/696 |
| 6,622,448 | B1 * | 9/2003 | Sonne | E04D 13/1625 | 52/656.1 |
| 8,733,064 | B2 * | 5/2014 | Madison | E04D 13/152 | 52/95 |
| 10,280,617 | B2 * | 5/2019 | Monty | F16B 15/00 | |
| 12,509,877 | B2 * | 12/2025 | Allen | E04B 1/388 | |
| 2002/0050104 | A1 * | 5/2002 | Reeves | E04D 13/178 | 52/287.1 |
| 2002/0178659 | A1 * | 12/2002 | Reeves | E04D 13/00 | 52/96 |
| 2003/0051419 | A1 * | 3/2003 | Suzuki | E04D 3/30 | 52/198 |
| 2007/0234666 | A1 * | 10/2007 | Porter | E04B 7/045 | 52/334 |
| 2010/0064602 | A1 * | 3/2010 | Moore | E04D 13/1625 | 52/95 |
| 2012/0047831 | A1 * | 3/2012 | Polumbus | E04D 13/172 | 52/302.1 |
| 2014/0165481 | A1 * | 6/2014 | Pavlansky | E04D 13/174 | 52/302.1 |
| 2018/0038094 | A1 * | 2/2018 | Brekke | E04B 1/2612 | |

* cited by examiner

VENTILATION BAFFLE SKIRT

FIELD OF THE DISCLOSURE

This disclosure relates to a ventilation baffle skirt for use with ventilation baffle for manufactured structure construction, including the construction of manufactured homes.

BACKGROUND OF THE DISCLOSURE

Manufactured home construction requires production of homes which meet increasingly stringent energy efficiency standards. These efficiency standards include guidelines for materials and dimensions for components of the manufactured home. Materials used for components, insulation values for components, reduction in carbon foot-print when in use, the ability to create a livable environment utilizing a reduced amount of energy and the like are among the goals of these standards. Adapting current building materials to fulfill these standards is time consuming and inefficient. For example, currently available ventilation baffle systems (including baffles and skirts, sometimes referred to in building construction vernacular as attic baffles and blocking, but not limited to applications in which there is accessible space below a roof and above a ceiling) need adjustment to achieve the required air gap between the roof decking and baffle material which serves as a barrier layer above insulating material. Conventionally used ventilation baffle systems also require separate securing mechanisms to affix the baffles and their corresponding skirts to roof trusses, and possibly neighboring baffles.

Therefore, there is a need to provide a ventilation baffle system including a ventilation baffle and baffle skirt that may improve the energy efficiency needs of manufactured homes.

SUMMARY OF THE DISCLOSURE

As demonstrated in the following sections, a ventilation baffle skirt is disclosed that can be utilized with multiple configurations of roofing trusses to meet the needs of improved energy efficient manufactured structures, such as homes. The solution is also useful to increase efficiency in constructing manufactured homes, both saving time and reducing the parts needed. For example, the need for fewer fasteners not only reduces part count, but also reduces the amount of installation time needed for fastening parts together in the construction of a manufactured structure.

A ventilation baffle skirt made of a sheet of material with two or more truss slots separated by a distance and with a plurality of truss overhangs is disclosed. The distance that separates the two or more truss slots is measured from the center of each slot. The plurality of truss overhangs are each connected to one of the two or more truss slots. Each of the truss overhangs may be connected to a corresponding one of the truss slots at a top portion. Each of the plurality of truss overhangs may be defined in part by a perforated outline. The perforated outline may also define, in part, a corresponding one of the two or more truss slots. In such examples of a ventilation baffle skirt, the perforated outline defines a width corresponding to a truss width for each of the two or more truss slots. Further, the perforated outline may define an overhang width corresponding to a truss width.

In some examples of the ventilation baffle skirt, each sheet of material is rectangular with a sheet width in a first direction and the sheet width corresponding to a multiple of the distance between each of the two or more truss slots. A second direction of the sheet may be in a direction along a length of the two or more truss slots of such ventilation baffle skirts. For such ventilation baffle skirts, the rectangular sheet of material may have a top side parallel to the first direction. In such ventilation baffle skirts, each of the two or more truss slots has a portion spaced from the top side of the sheet of material, and the ventilation baffle skirt, ventilation baffle, and multiple trusses are configured to define a plenum with a depth corresponding to a predetermined plenum depth.

In some ventilation baffle skirts, each of the two or more truss slots may have a width greater than that of a standard roof truss. The width of each of the two or more truss slots may accommodate deviations in a pitch of trusses in a structure in which the ventilation baffle skirt will be used in some such ventilation baffle skirts. Additionally, the width of each of the two or more truss slots may accommodate deviations in a width of the standard roof truss. The material of the ventilation baffle skirt may be lightweight, temperature resistant, moisture resistant, and sufficiently robust to resist fraying during installation and securing. The material may also include any of a fibrous material, a cardboard material, fiberglass, a plastic, a recycled material, a recycled plastic, a composite material, and a metal material. Specifically, the material may be a recycled plastic that is lightweight, temperature resistant, moisture resistant, and sufficiently robust to resist fraying during installation and securing.

A first ventilation baffle skirt may be configured to nest above a second ventilation baffle skirt of similar dimensions such that when the first ventilation baffle skirt is laid above the second ventilation baffle skirt, the two or more truss slots of the first ventilation baffle skirt are overlaid onto the two or more truss slots of the second ventilation baffle skirt and edges of the first ventilation baffle skirt align with edges of the second ventilation baffle skirt. In some such ventilation baffle skirts, a first truss slot of the two or more truss slots is located a first edge distance from a first end of the sheet and a last truss slot of the two or more truss slots is located a second edge distance from a second end of the sheet, the first edge distance being equal to the second edge distance. The first ventilation baffle skirt and the second ventilation baffle skirt may have a nestable configuration.

A system that includes a ventilation baffle and a ventilation baffle skirt in which the ventilation baffle skirt has two or more truss overhang/slot assemblies that complement two or more truss channels of the ventilation baffle is disclosed.

The system may be configured to partially define an enclosed area when installed on two or more roof trusses of a structure. In such a system, the two or more truss overhang/slot assemblies of the ventilation baffle may be regularly spaced apart at an interval of either one half or one third that of the interval between the two or more roof trusses. Additionally, or alternatively, the enclosed area may be further bounded by a ceiling of a structure when the system is installed on the two or more roof trusses such that the ventilation baffle and the ceiling make up opposite sides of the enclosed area. In some systems described herein, the enclosed area may be beneath an air gap, and the air gap may be defined by a roof decking, the ventilation baffle, and the two or more roof trusses. In such systems, the air gap may have a predetermined depth between the roof decking and the ventilation baffle, and the ventilation baffle skirt may be configured to maintain the predetermined depth.

In some examples of the system, the ventilation baffle may be configured to be installed over the ventilation baffle skirt, and the ventilation baffle skirt may have one or more truss overhangs. Each overhang may be adapted to overlay a truss of a structure, and part of one of the two or more truss channels of the ventilation baffle may overlay each overhang in some such systems. The ventilation baffle and ventilation baffle skirt may be adapted to use a single securing mechanism so that the system is secured to two or more trusses of a structure such that the single securing mechanism penetrates both the ventilation baffle and the ventilation baffle skirt when the system is in use.

A method of making a ventilation baffle skirt is provided, in which the method includes forming a ventilation baffle skirt having a sheet of material with two or more truss slots separated by a distance measured from each truss slot's center, and a plurality of truss overhangs, each of the plurality of truss overhangs connected to one of the two or more truss slots. The sheet of material may be formed from a material that includes: a fibrous material; a cardboard material; fiberglass; a plastic; a recycled material; a recycled plastic; a composite material; or a metal material.

A method of using a ventilation baffle skirt includes placing the ventilation baffle skirt over multiple roof trusses in a manufactured structure, slotting each of the multiple roof trusses into one of the multiple truss slots of the ventilation baffle skirt, laying a ventilation baffle over the multiple roof trusses, installing roof decking over the ventilation baffle, and securing the roof decking, the ventilation baffle skirt, and the ventilation baffle to the multiple roof trusses at multiple locations along each of the multiple trusses. In such a method, at each location along each of the multiple roof trusses, a single securing mechanism penetrates the roof decking, the ventilation baffle, the ventilation baffle skirt, and the roof truss simultaneously, with the roof truss being one of the multiple roof trusses. The single securing mechanism includes any of a staple, a nail, a screw, a strap, or a combination of a strap and a staple, a nail, or screw. The ventilation baffle skirt may include multiple truss slots that are regularly spaced apart at an interval of either one half or one third of the interval between multiple roof trusses. The multiple locations for securing the roof decking, the baffle skirt, and the baffle to a truss include centered locations on each truss.

The method may include creating a space bounded in part by the ventilation baffle, a ceiling of the structure, and the ventilation baffle skirt, with the ventilation baffle and the ceiling making up opposite sides of the space. The space may be created by securing the roof decking, the ventilation baffle skirt, and the ventilation baffle to the multiple trusses. The method may include slotting the ventilation baffle skirt over multiple roof trusses, in which the ventilation baffle skirt includes a truss slot positioned about each one of the multiple truss slots. The method may also include securing the ventilation baffle skirt to multiple roof trusses.

The ventilation baffle skirt may include a truss slot positioned around each one of the multiple truss slots. Each of the two or more truss slots may have a width that is greater than that of a standard roof truss in some examples of a ventilation baffle skirt. In some such examples, the width of each of the two or more truss slots accommodates deviations in a pitch of trusses in a structure in which the ventilation baffle skirt will be used.

A ventilation baffle in combination with a ventilation baffle skirt, two or more roof trusses and a ceiling of a structure that define an enclosed area is disclosed. The enclosed area has a first side defined by the ceiling and a second side opposite the first side that is defined by the ventilation baffle. The enclosed area is configured to surround insulation material. The ventilation baffle skirt includes a sheet of material with multiple slots that are separated by a regular distance in which the regular distance corresponds to either half or one third of a distance between each of the two or more roof trusses as measured from the center of each of the two or more roof trusses. The enclosed area formed by the combination may be beneath a plenum. The plenum may be defined by a roof deck, the ventilation baffle, and the two or more roof trusses, in which the plenum has a predetermined air gap depth between the roof decking and the ventilation baffle. In such combinations, the ventilation baffle skirt may be configured to maintain the predetermined air gap depth.

DETAILED DESCRIPTION OF THE PREFERRED EMBODIMENTS

Figure 1:
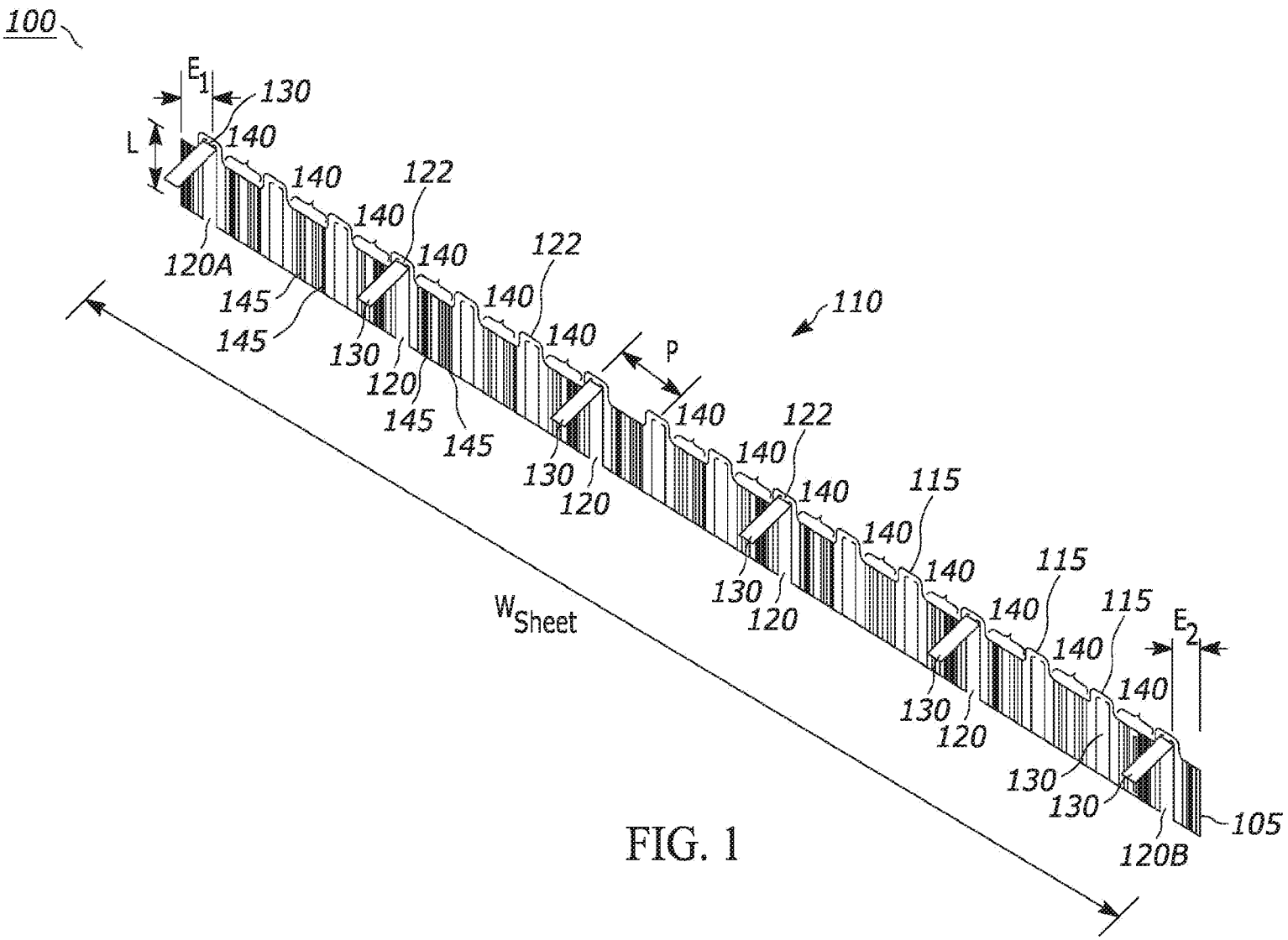
FIG. 1 is a rear perspective view of a first embodiment of a ventilation baffle skirt.

Having reference to the drawings, where like reference numbers comprise like elements, there is illustrated in FIG. 1 a ventilation baffle skirt, generally denoted by reference number 100. This ventilation baffle skirt 100 is made of a sheet of material 105 with a length L and a width $W_{SHEET}$. The overall shape of the sheet of material 105 is rectangular. The ventilation baffle skirt 100 has a plurality of parallel truss slots 120 oriented along the length L of the sheet of material 105. Each truss slot 120 is attached to a truss overhang 130 at a top portion 122 located within a top side 110 of the ventilation baffle skirt 100, the top side 110 being parallel to the width $W_{SHEET}$ of the ventilation baffle skirt 100. The combination of the truss slot 120 and the truss overhang 130 is an overhang/slot assembly 115. Between each pair of assemblies 115 is a corrugated portion 140 that is designed to provide buckling resistance along the length of the ventilation baffle skirt.

Figure 2A:
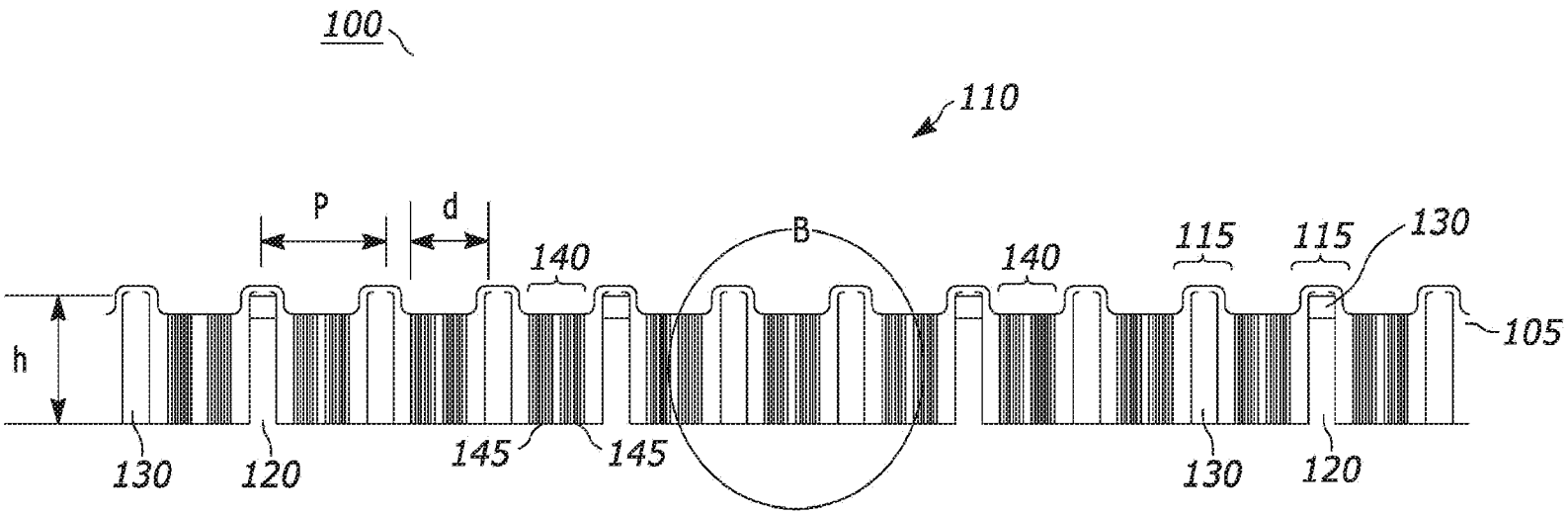
FIG. 2A is a front view of the ventilation baffle skirt of FIG. 1.
Figure 2B:
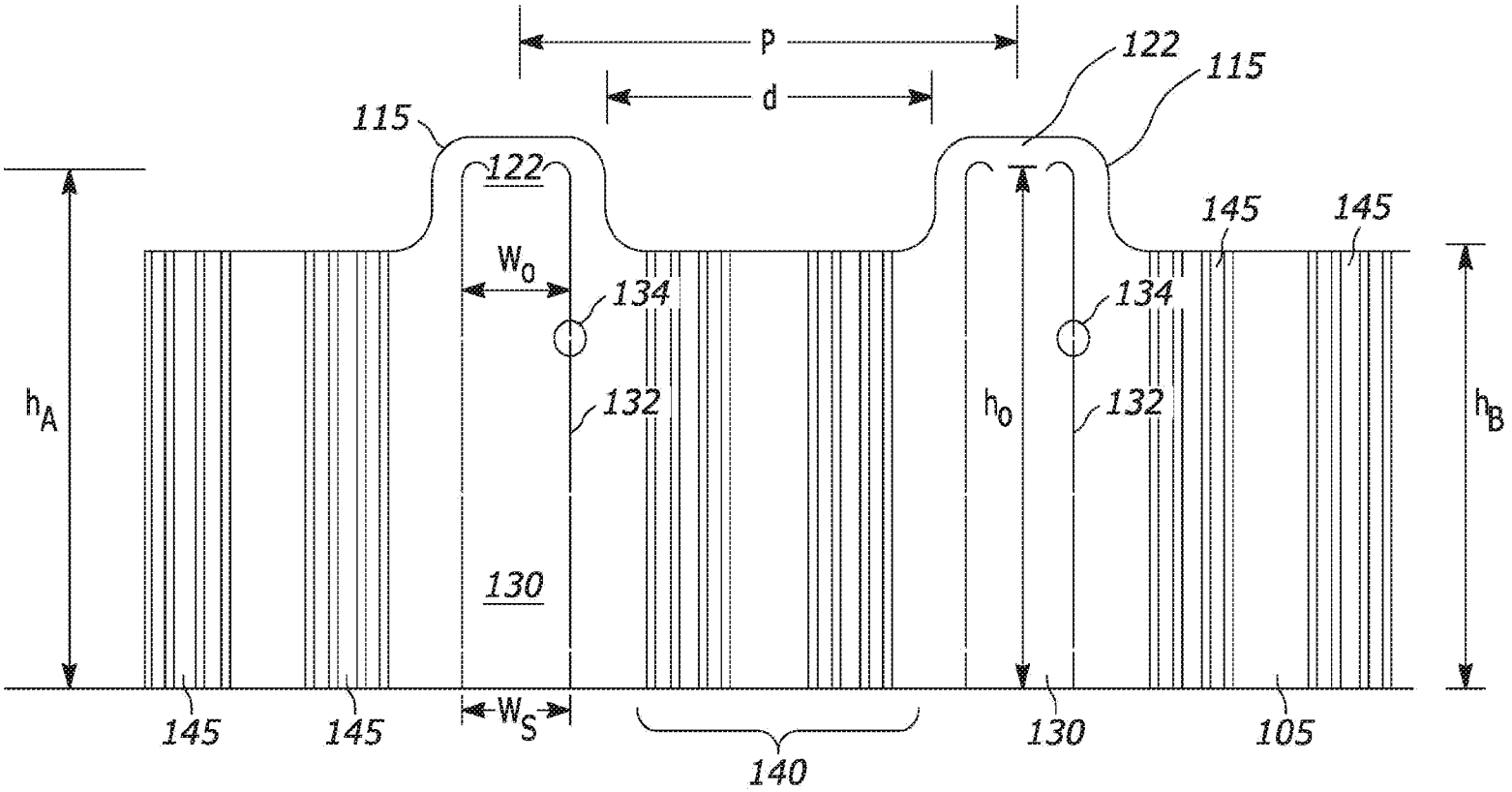
FIG. 2B is an enlarged view of the inset circle AB of the front elevation of FIG. 2A.

FIG. 2A is a front elevational view of the ventilation baffle skirt 100 of FIG. 1, and FIG. 2B is an enlarged view of the encircled portion of FIG. 2A denoted as B. In these figures the distance, or pitch, P between adjacent overhang/slot assemblies 115, measured from the midpoint of each truss channel slot 120, is uniform across the width $W_{SHEET}$ of the ventilation baffle skirt 100. The distance of the corrugated portion 140 between each pair of overhang/slot assemblies 115 is a distance d. Each overhang/slot assembly has a height $h_A$, and the height of the corrugated portions 140 is $h_B$. Each truss slot 120 has a width $W_S$, and each truss overhang 130 has a width $W_O$.

As mentioned above, in an overhang/slot assembly 115, the overhang 130 is connected to the slot 120 at a top portion 122. When the overhang 130 is in use and attached to a truss, this top portion 122 may be the only point that connects the overhang 130 to the slot 120, and in turn to the rest of the ventilation baffle skirt 100. However, before being put into use, each of the overhang/slot assemblies 115 of the ventilation baffle skirt 100 has their respective overhang 130 attached to the edges of the slot 120 in addition to the top portion 122. As fabricated, and before being put in service, in each overhang/slot assembly 115, the overhang 130 is defined by a perforated edge 132. The perforated edge 132 also defines the inner portion of the slot 120 of a given overhang/slot assembly 115. Connecting portions 134 interrupt the outline of the perforated edge 132. The connecting portions 134 keep each overhang 130 connected and held in a position that is flush with the material sheet 105 of the ventilation baffle skirt 100. In other words, the connecting portions 134 hold each overhang 130 within its corresponding slot 120 until the overhang 130 is put to use to be placed on a truss. In this way, the ventilation baffle skirt 100 may have flexibility in the points where it attaches to trusses in a structure. That is to say that multiple configurations are possible for the ventilation baffle skirt 100 as it attaches to trusses.

As illustrated in FIGS. 1-2B, each ventilation baffle skirt has a regular distance (i.e., pitch) P between adjacent truss slots 120, as measured from the midpoint of the truss slots 120. However, a distance $E_1$ from the edge of the ventilation baffle to the midpoint of the first truss slot 120A as viewed along the width $W_P$ of the ventilation baffle skirt 100 differs from the pitch P between adjacent truss channels 120. Similarly, the last truss slot 120B, which has only one adjacent truss slot 120 is a distance $E_2$ from its midpoint to the edge or end of the ventilation baffle. The pitch P between the ventilation baffle slots 120 is a regular distance. This distance corresponds to either one half (½) or one third (⅓) of the distance between trusses in a structure. Because the pitch P may accommodate different truss spacings, the overhangs 130 may be selectively separated from the surround material of their respective overhang/slot assembly 115 to create both a slot 120 which fits over a truss and an overhang 130 which may be used to attach the ventilation baffle skirt 100 to a truss.

The distance between the truss slots 120 at the ends of the ventilation baffle skirt 100 may not maintain, or have the same, the pitch P used in the bulk of the ventilation baffle skirt 100. Turning once again to FIG. 1, at a first end of the ventilation baffle skirt 100 there is a first truss slot 120A located a first distance $E_1$ away from the edge of the ventilation baffle skirt 100, and similarly at a second end of the ventilation baffle skirt 100, there is a last truss slot 120B that is a second distance $E_2$ away from the edge of the ventilation baffle skirt 100. In some examples, the distances $E_1$ and $E_2$ may be substantially equal to one half (½) of the distance d between adjacent overhang/slot assemblies 115. Additionally, or alternatively, the first distance $E_1$ and the second distance $E_2$ are the same. Such a configuration could facilitate the use of multiple ventilation baffle skirts 100 of similar configuration in series to span the trusses in a roof structure. This ease of use could be accomplished by overlapping the first truss slot 120A of a ventilation baffle skirt 100 that is being installed (i.e., a subsequent ventilation baffle skirt) over the last truss slot 120B of a ventilation baffle skirt 100 that has already been installed (i.e., an existing ventilation baffle skirt) over trusses. In other words, the first truss slot 120A of a subsequent ventilation baffle skirt would be placed on the same truss as the last truss slot 120B of an existing ventilation baffle skirt. Such placement could reduce the amount of overlap needed between the existing and subsequent ventilation baffle skirts while providing adequate functionality of the ventilation baffle skirts.

In order to accommodate the overlap of a first and second ventilation baffle skirt, the distance $E_1$, $E_2$ from a first or last truss slot 120A, 120B to an edge of a ventilation baffle skirt 100 is consistent. This distance $E_1$, $E_2$ may be, for example, preferably 4 inches (10 cm). The dimensions of the sheet of material 105 which makes up the ventilation baffle skirt 100 are length L by width $W_{SHEET}$. Length L is preferably approximately 30 inches (76.2 cm), and the width $W_P$ is variable and may depend of building standards, including standards for roof pitch. The regularity of the placement of truss slots 120 and the ability of ventilation baffle skirts 100 to be overlapped allows for any excess ventilation baffle skirt material to be trimmed and used in the construction of another structure. This also reduces waste with respect to the ventilation baffle skirts 100.

Figure 3:
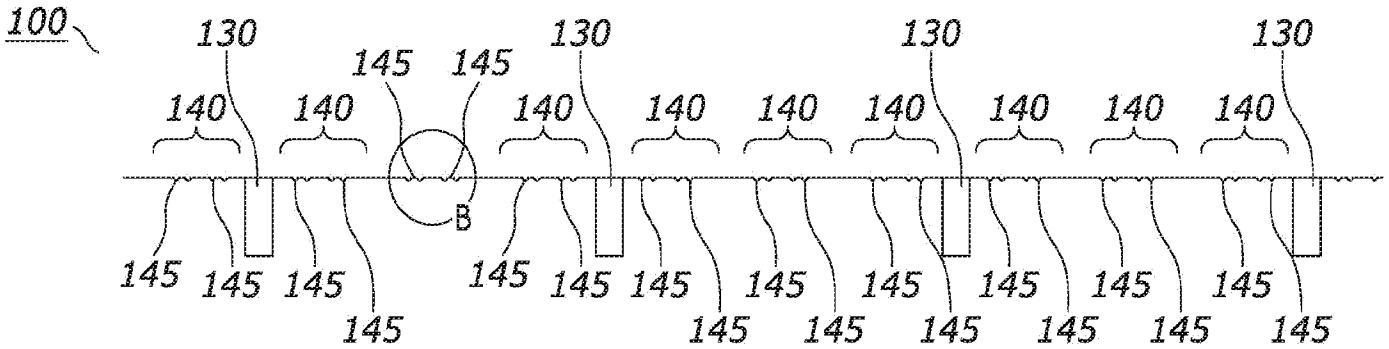
FIG. 3 is a top plan view of ventilation baffle of the ventilation baffle skirt of FIG. 1.
Figure 4:
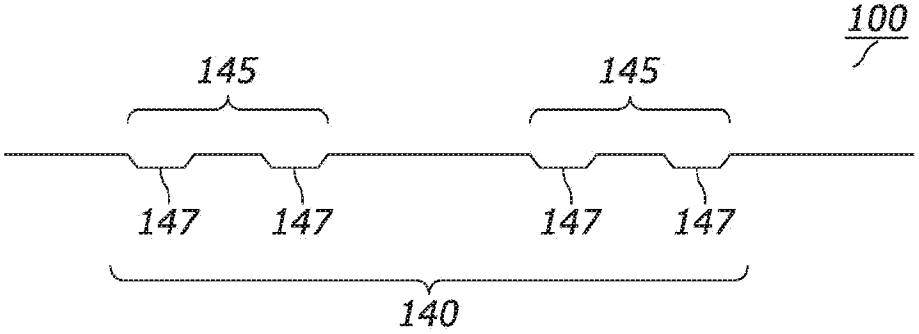
FIG. 4 is an enlarged view of the top plan view of the ventilation baffle skirt shown in FIG. 3.

Turning now to FIG. 3, which shows a top-down view of the ventilation baffle skirt 100, and FIG. 4 which is an enlarged view of a portion B of the ventilation baffle skirt 100 shown in FIG. 3. It can be seen that corrugated portions 140 are spaced evenly along the width of the ventilation baffle skirt 100. In the example ventilation baffle skirt 100 shown in FIG. 3 and FIG. 4, each corrugated portion 140 has two individual corrugations 145. Each individual corrugation 145 has two protruding areas 147 interrupting what would be a straight path through the corrugated portion 140, connecting adjacent overhang/slot assemblies 115. As mentioned above, the corrugations 145 prevent buckling of the ventilation baffle skirt 100 along its length L, while allowing for flexibility along the width $W_{SHEET}$ of the ventilation baffle skirt 100. In other examples, each corrugated portion 140 may have one individual corrugation 145 or three or more individual corrugations 145. Other configurations are possible.

For convenience during transportation, the ventilation baffle skirts 100 may be designed to be nestable, such that the ventilation baffle skirts 100 can be stacked with their edges aligned. In addition to allowing the ventilation baffle skirts 100 to be stacked with ventilation baffle skirts of similar configurations for ease of transport, another benefit of the nestable nature of the ventilation baffle skirts 100 is that the nestability allows a first ventilation baffle skirt to be securely joined to another ventilation baffle skirt of similar configuration to cover the length of a roof without the need for any fasteners between or joining the skirts together.

Figure 5B:
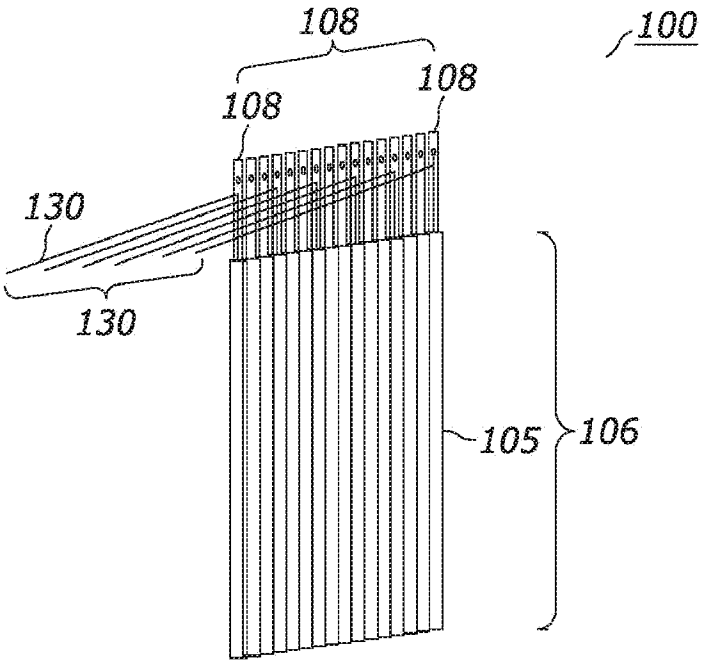
FIG. 5B is another perspective view of the ventilation baffle skirt of FIG. 1.
Figure 5A:
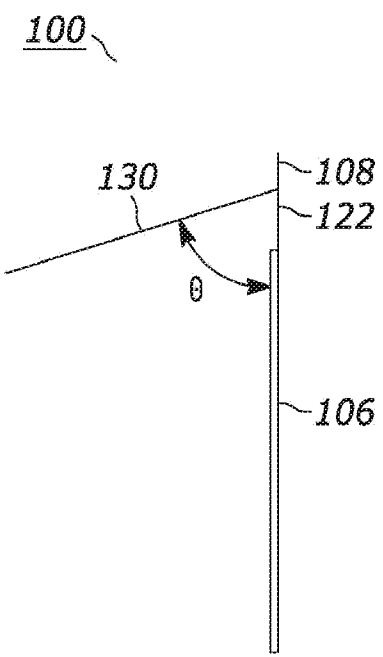
FIG. 5A is a side view of the ventilation baffle skirt of FIG. 1.

In FIGS. 5A and 5B, the ventilation baffle skirt 100 is shown from the side (i.e. side elevation), as well as from a side perspective. These figures show the ventilation baffle skirt 100 with some of the truss overhangs 130 in a use position, away from the rest of the ventilation baffle skirt 100. The truss overhangs 130 that are not in the use position are in an as-manufactured configuration, connected to the rest of the overhang/slot assembly 115. The ventilation baffle skirt 100 includes a retaining portion 106 and tabs 108 which fit into ventilation baffle channels (shown in FIG. 6). In FIG. 5A, it can be seen that when in use, there is an angle θ between the truss overhangs 130 and the retaining portion 106 of the ventilation baffle skirt 100. This angle θ may be the same or substantially the same as the slope of the trusses in a structure. Additionally, or alternately, the angle θ may be the same or substantially the same as the angle between the roof deck of a structure and a sidewall of the structure if the sidewall were extended upwards. In other words, the retaining portion 106 of the ventilation baffle skirt may be thought of as an extension of the sidewall of the structure upwards until it intersects the structure's roof deck.

The ventilation baffle skirt 100 described herein is configured for use with a ventilation baffle that is complementary in terms of its configuration and adaptability to different truss configurations. Such a ventilation baffle is the subject of U.S. patent application Ser. No. 18/583,624 filed on Feb. 21, 2024, titled "Ventilation Baffle," which is hereby incorporated by reference. The combination of a ventilation baffle and a ventilation baffle skirt 100 is a system which may be used in constructing a structure. This system of the ventilation baffle and the ventilation baffle skirt 100 partially define an enclosed area when installed on two or more roof trusses of a structure as seen in FIG. 6.

In some examples, the configuration of the ventilation baffle skirt 100 enables it to fit with a complementary ventilation baffle to retain insulation material and create a plenum of uniform depth between the ventilation baffle and roof decking. Such complementary ventilation baffles may have multiple truss channels which are distanced apart from each other at the same pitch as the overhang/slot assemblies 115. These truss channels may be sized to create the floor of the plenum, as shown in FIG. 6. The shape of the overhang/slot assemblies 115 may complement that of the truss channels, thus providing the aforementioned enclosed area which is configured to retain insulation material with the goal of preventing the insulation from entering a soffit area of the structure, as well as preventing air flow through the enclosed area.

Figure 6:
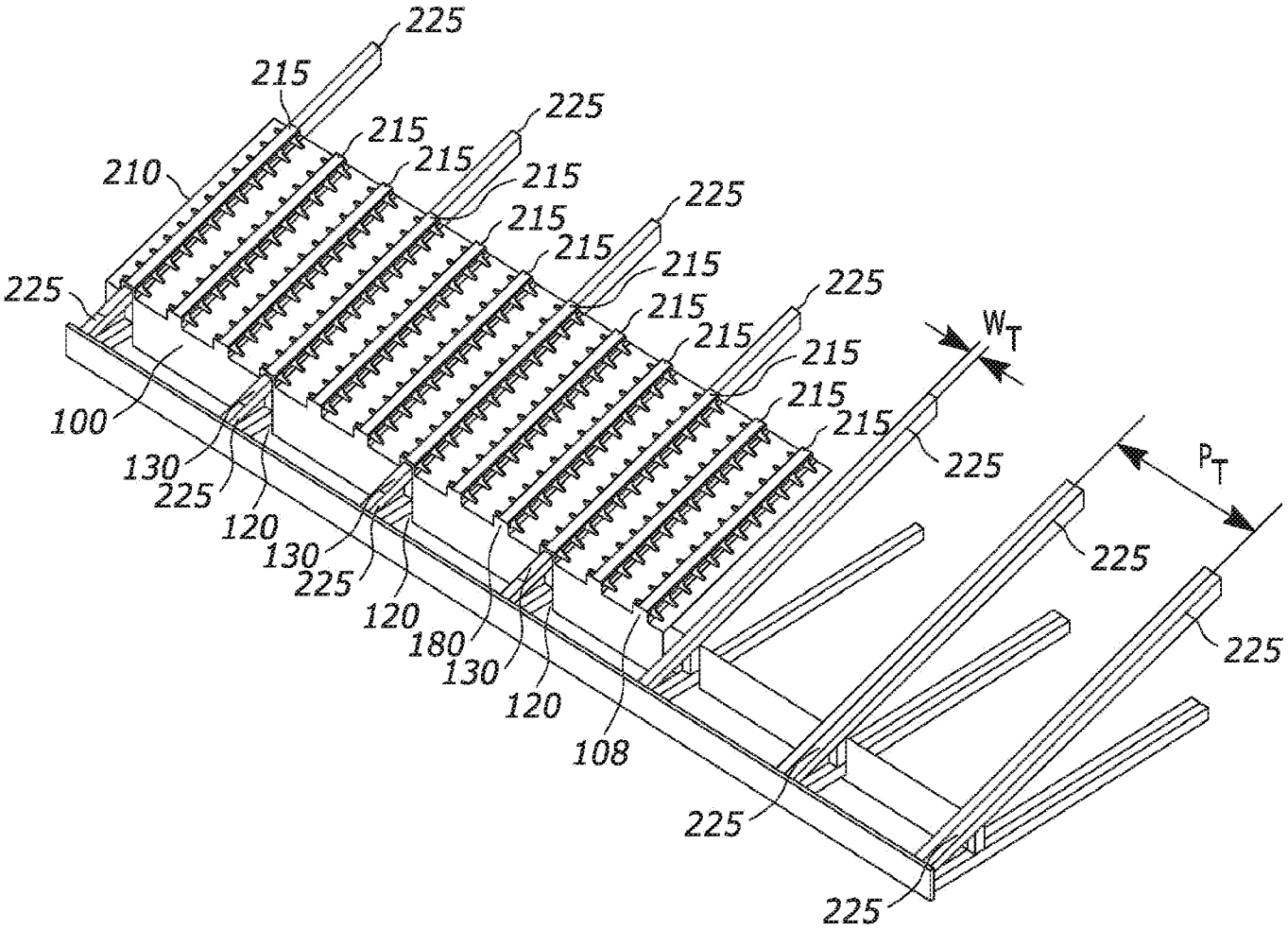
FIG. 6 is a perspective view of a ventilation baffle installed on roof trusses and in use with a ventilation baffle.

FIG. 6 illustrates a ventilation baffle 210, trusses 225, and the ventilation baffle skirt 100 described herein assembled in a roof structure. These components are shown without the roof decking, ceiling, and insulation. In this example, the tabs 108 shown in FIGS. 5A and 5B are configured to fit into truss channels 215 in the ventilation baffle 210 which are not covering a truss 225. The truss overhangs 130 are shown as each laying over a truss 225. The truss overhangs 130 serve to allow slots 120 to form for fitting the ventilation baffle skirt 100 over a series of trusses 225 as well as to provide areas for attachment or securing the ventilation baffle skirt 100 to the trusses 225.

The ventilation baffles skirts 100 described herein are configured for use with manufactured homes having roof trusses 225 with intervals between the trusses, measured center to center of the trusses, of either 16 inches (40.64 cm) or 24 inches (60.96 cm). To accommodate both of these truss configurations, the pitch $P_T$ between truss slots 120, measured center to center of the truss slots 120, is approximately 8 inches (20.32 cm). The spacing between trusses 225 may vary, and in some uses, every second truss slot 120 is laid over a roof truss 150. In other words, the truss slots 120 of the ventilation baffles 100 may be regularly spaced apart at an interval of either one half or one third that of the interval between adjacent roof trusses 225.

The width $W_S$ of each of the truss slot 120 is sized to accommodate the width $W_T$ of a standard roof truss 225, as well as variations in construction of roof framing construction. For example, the truss slots 120 may be sized to accommodate variation of the placement of roof trusses 225, such as being 1.25 times the width of standard roof truss 225. Because the truss slots 120 are larger than the trusses 225, the ventilation baffle skirt 100 can be used with trusses 225 assembled within a reasonable deviation from the most commonly used intervals of 16 inches (40.64 cm) and 24 inches (60.96 cm).

The sheet of material 105 used to form the ventilation baffle skirt 100 may be any easily formed material including a metal, a stamped metal, an extruded material, an extruded metal, an extruded polymer (e.g., plastic), an injection molded plastic (e.g., polymer), a recycled material, an injected molded recycled plastic, a cardboard material, a fibrous material, fiberglass, a composite material, or any combination thereof. The material for the sheet of material 105 may be selected for characteristics including being lightweight, temperature resistance, moisture resistance, robustness, toughness, and resistance to degradation with exposure to other building materials. Toughness may include the ability of the material to resist fretting, fraying, or crumbling during or after installation near the areas where fasteners, such as staples, nails, or screws, pass through the sheet of material 105. Temperature resistance may include a tolerance in the range of below −40 degrees C. to above 50 degrees C. Moisture resistance may include maintenance of toughness and ruggedness in extremely dry ambient conditions as well as in predominantly damp conditions.

Figure 7:
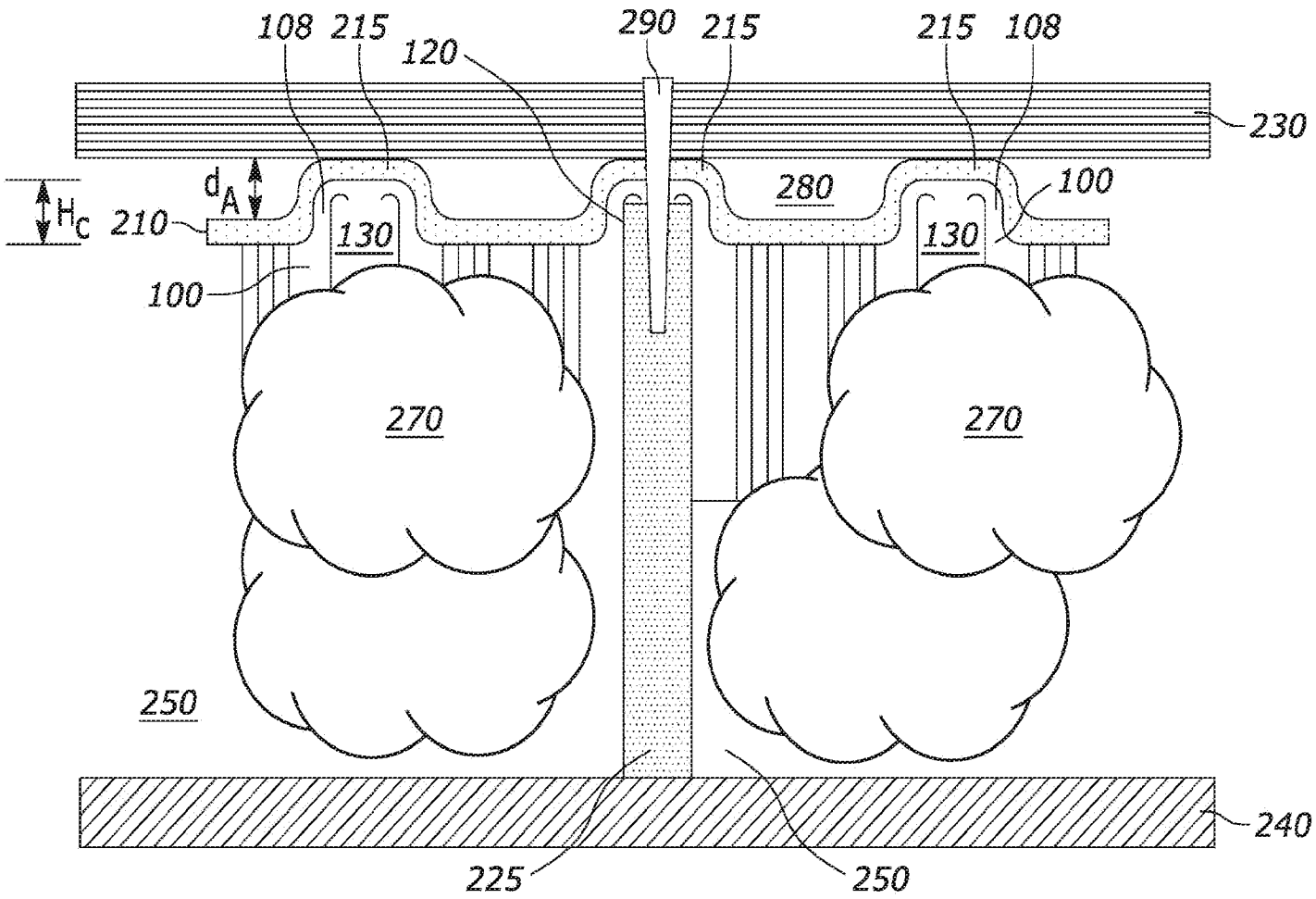
FIG. 7 is a cross-sectional, semi-schematic view of a portion of a roof of a manufactured home illustrating roof decking, trusses, insulation material, a ventilation baffle, a ventilation baffle skirt, and an enclosed area, or plenum, created by this assembly of components.

FIG. 7 is a cross-sectional view of a roof of a manufactured home in the process of being assembled. The section shows a ventilation baffle 210 with a ventilation baffle skirt 100 in contact with a truss 225. The truss 225, ventilation baffle 210, and ventilation baffle skirt 100 in conjunction with a building's ceiling 240 create a space 250 which may enclose insulation material 270. A section of roof decking 230 is shown as secured to a truss 225 with a fitting 290 which also passes through and secures the ventilation baffle 210 and the ventilation baffle skirt 100 to the truss 225. Once affixed to the truss 225, the roof decking 230, the ventilation baffle 200, and the ventilation baffle skirt 100 create an air gap 280. Once the roof is fully constructed, the air gap 280 allows for air flow beneath the roof decking 230 without disturbance of any installed insulation, and the ventilation baffle skirt 100 may aid in maintain the predetermined air gap depth.

The air gap 280, is bounded in part by the ventilation baffle 200 on a first side and in part by the roof decking 230 on a second side, with the first and second sides opposite each other. The air gap 280 is constructed to have a depth $d_A$. Beneath the air gap 280, the enclosed space 250 may be formed. The enclosed space 250 is bounded by the ventilation baffle 210, the ceiling 240, the truss 225, and the ventilation baffle skirt 100. The ventilation baffle 210 and the ceiling 240 are opposite each other, with insulation 270 in between. In use, the ventilation baffle skirt 100 retains the insulation 270 in the space 250 while air flows through the plenum (air gap) 280.

During construction of a structure, the ventilation baffles 210 and ventilation baffle skirts 100 are held in place over the trusses 225 by gravity and/or friction until roof decking 230 is placed over the ventilation baffles 210 and baffle skirts 100 and fastened. The same fasteners are used to secure the roof decking 230 to trusses 225. Securing the ventilation baffles 210 and ventilation baffle skirts 100 to trusses 225 may involve placing roof decking 230 over the ventilation baffles 210 which are over-laid on the trusses 225 and the truss overhangs 130. Then, using a single securing mechanism (fastener 290) which penetrates all four of the components: the roof decking 230, the ventilation baffles 210, the ventilation baffle skirt 100, and the truss 225 simultaneously, the components are finally secured together. The location of the fastener 290 or securement may be centered over each truss, with multiple securing mechanisms (e.g., screws, staples, nails) aligned on each truss, so that the roof decking 230, ventilation baffles 210, and ventilation baffle skirts 100 are firmly secured to the trusses 225.

A plurality of fasteners 290 are used to secure the roof decking 230 to at least two trusses 225. As described above, the ventilation baffle 210 is sandwiched between the trusses 225 and the roof decking 230, while the ventilation baffle's truss overhangs 130 cover the trusses. All of these components are secured in place with the plurality of fasteners 290. These fasteners 290 may include any of a nail, a screw, a strap, or a combination of a strap and a nail or screw. The ventilation baffle 210 and ventilation baffle skirt 100 may be secured to the truss 225 without employing a separate securing means to affix the ventilation baffle 210 and ventilation baffle skirt 100 to the truss 225. The ability of the ventilation baffle 210 and ventilation baffle skirt 100 to be temporarily affixed to trusses 225 and to each other prior to the roof decking 230 being added reduces the number of fasteners needed in the over-all construction of a manufactured home, reducing the parts needed and the time to assemble the manufactured home.

As illustrated in FIG. 7, the height $H_C$ of the truss channels 215 of the ventilation baffle 210 may be selected to create an air gap 280 of a predetermined height, for example a 1-inch (2.54 cm) air gap. To create such an air gap, the height $H_C$ of each truss channel 215 is approximately 1 inch (2.54 cm). The truss channels 215 are sized or configured to accommodate the standard roof trusses used in the manufactured home industry, including slight variations in the placement of the roof trusses during construction of a manufactured home. Preferably, the truss channels 215 have a width of approximately 1.25 inches (3.175 cm). Truss channels 215 are wide enough to accommodate deviations in roof assembly in structures, including in manufactured homes. Construction may deviate from the ideal truss pitch (i.e., distance between the center of each truss), truss thickness, or both pitch and thickness. To accommodate these deviations in construction, the truss channels 215 have a width greater than that of a standard truss. Truss channels 215 may vary in width from the ideal (i.e., standard) width of a truss 150 in a range of +5% to +10% of standard truss thickness. For example, some structures may use lumber that has a cross-section of 2 inches (5.08 cm) by 4 inches (10.16 cm) (i.e., 2×4s), and in that case truss channels 215 may have a width in the range of 2.1 inches (5.334 cm) to 2.2 inches (5.588 cm).

The width of the truss slots 120 and truss channels 215 may accommodate the trusses used in fabrication of the structures as well variations in construction, as described above. The depth of the truss channels 215 may also conform to current building standards and may preferably be 1 inch (2.54 cm). These dimensions may be adjusted to accommodate changes in the standards used by the manufactured structure industry or to improve manufacturability of the ventilation baffle. For example, should the required air gap become 2 inches (5.08 cm), then the height $H_C$ of the truss channels 215 can change to be 2 inches (5.08 cm). Changes in the required air gap may change the point where the truss overhang 130 is joined to the truss slot 120 when the truss overhang 130 is in use. Additionally, the distance between truss channels 215 and truss slots 120 as measured on center may be varied to accommodate the pitch of trusses of the structures in which they will be used.

The sheet of material used to fabricate the ventilation baffle skirt may be selected for various characteristics including strength to weight ratio, being lightweight, temperature resistance, moisture resistance, toughness (e.g., ability to resist fraying during and after installation), formability, "greenness", insulative properties, robustness, cost, and the like. For example, post-consumer recycled polymer (e.g., recycled plastic) may be selected as the sheet material because it may have a reduced carbon footprint, it may be easily and quickly molded, and it may be suitably tough to endure the handling and securing process, as well as the temperature fluctuations endured by a typical roof. The material selected for the ventilation baffle skirt may be sufficiently robust to resist fraying during the installation and securing process, as well as being sufficiently resistant to fretting (e.g., wear) around points of securement. The material used to fabricate the ventilation baffle and the ventilation baffle skirt may be the same or may be different. The material selection for the baffle and its skirt may be based on the conditions of that the components are exposed to when in use or for ease of fabrication, or for both use and manufacturing considerations.

The selection of the material of the ventilation baffle in combination with the depth $d_A$ of the air gap can increase the insulative capability of a roof and decrease the humidity levels in the roof area. The decrease in the humidity levels in the roof area is facilitated by more robust air exchange due to the materials used for the baffles and the configuration of the created air gap. These features combined may aid a structure, such as a manufactured home, in meeting energy efficiency standards. The use of fasteners that secure the roof decking, ventilation baffle, and ventilation baffle skirt at once to the trusses reduces the time needed to complete that portion of the roof structure, thus increasing the efficiency of constructing a manufactured home.

Figure 8:
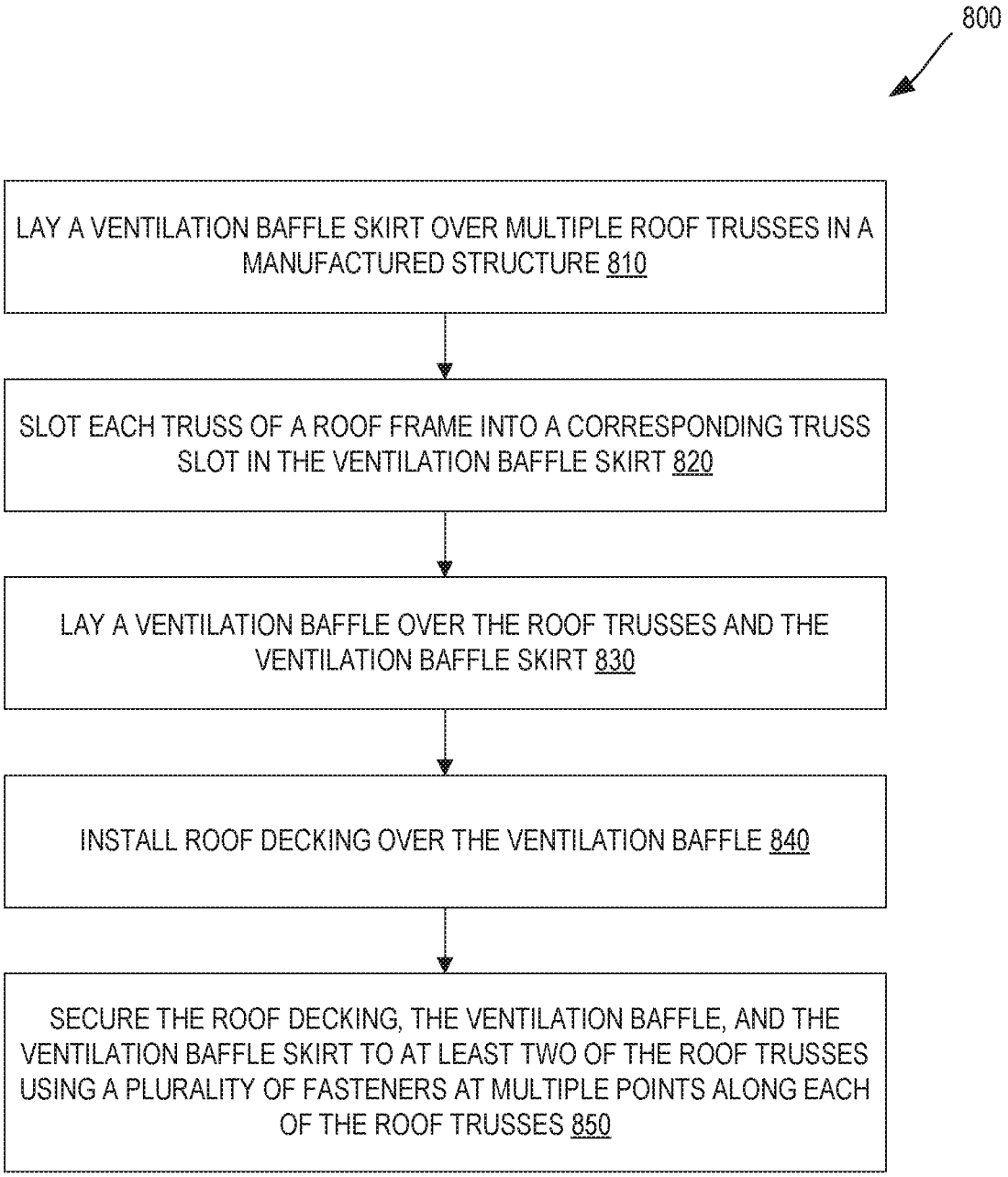
FIG. 8 is a flow diagram of a method for installation of a ventilation baffle skirt on a manufactured structure.

In use, a ventilation baffle may be installed as shown in the method illustrated in FIG. 8. A first step includes laying the ventilation baffle skirt over multiple roof trusses in a manufactured structure as in 810. While laying the ventilation baffle skirt over roof trusses, or after such laying, each truss of a roof frame may be slotted into a corresponding truss slot in the ventilation baffle skirt while overlaying a truss overhang on each truss, as in step 820. Once the ventilation baffle skirt and the trusses are temporarily joined via the truss overhangs and truss slots, the next step 830 in installation involves laying a ventilation baffle over trusses and the ventilation baffle skirt, particularly over the truss overhangs. Installing roof decking over the ventilation baffle is a next step 840. Securing the roof decking, ventilation baffle, and ventilation baffle skirt to at least two of the trusses using a plurality of fasteners at multiple points along each of the trusses is a following step 850. This sandwiches the ventilation baffle and ventilation baffle skirt between the roof decking and the trusses. A single fastener, or a single securing mechanism, may be used to secure the roof decking to a truss, with a ventilation baffle and ventilation baffle skirt overhang in between. It is not necessary to use staples to secure the ventilation baffle and/or the ventilation baffle skirt to a truss then to secure the roof decking using yet another staple or a nail or screw. The ventilation baffle and ventilation baffle skirt may be visually inspected after the roof decking has been overlaid and all of the ventilation baffle, ventilation baffle skirt, and roof decking have been secured to the roof trusses (e.g., roof frame).

While various embodiments of ventilation baffles for construction of manufactured homes have been described herein, it is recognized that this disclosure is not limited to these embodiments. Variations may be made thereto which are still within the scope of the appended claims.

What is claimed is:

1. A ventilation baffle skirt comprising:

a sheet of material with two or more truss slots separated by a distance measured from a center of each truss slot, the ventilation baffle skirt comprising:

a plurality of truss overhangs, each of the plurality of truss overhangs connected to one of the two or more truss slots, wherein each of the plurality of truss overhangs is connected to a corresponding one of the two or more truss slots at a top portion located within a top side of the sheet material, wherein each truss overhang has a first height and a portion of the sheet material between two truss overhangs has a second height that is less than the first height such that between the two truss overhangs the top portion is spaced from the top side of the sheet material.

2. The ventilation baffle skirt of claim 1, wherein each of the plurality of truss overhangs defined in part by a perforated outline, the perforated outline also defining in part a corresponding one of the two or more truss slots.

3. The ventilation baffle skirt of claim 2, wherein, for each of the two or more truss slots, the perforated outline defines a width corresponding to a truss width.

4. The ventilation baffle skirt of claim 2, wherein, for each of the plurality of truss overhangs, the perforated outline defines an overhang width corresponding to a truss width.

5. The ventilation baffle skirt of claim 1, wherein each sheet of material is rectangular, with: a sheet width in a first direction, the sheet width corresponding to a multiple of the distance between each of the two or more truss slots; a second direction, the second direction being along a length of the two or more truss slots; and a top side parallel to the first direction.

6. The ventilation baffle skirt of claim 5, wherein each of the two or more truss slots has a top portion spaced from the top side of the sheet of material, wherein the ventilation baffle skirt is configured for use with a ventilation baffle and multiple trusses to define an air gap with a depth corresponding to a predetermined air gap depth.

7. The ventilation baffle skirt of claim 1, wherein each of the two or more truss slots has a width greater than that of a roof truss.

8. The ventilation baffle skirt of claim 7, wherein the width of each of the two or more truss slots accommodates deviations in a pitch of trusses in a structure in which the ventilation baffle skirt will be used.

9. The ventilation baffle skirt of claim 7, wherein the width of each of the two or more truss slots accommodates deviations in a width of the roof truss.

10. The ventilation baffle skirt of claim 1, wherein the sheet of material is temperature resistant, moisture resistant, and configured to resist fraying during installation and securing, the material comprising any of a fibrous material, a cardboard material, fiberglass, a plastic, a recycled material, a recycled plastic, a composite material, and a metal material.

11. The ventilation baffle skirt of claim 10, wherein the sheet of material is a recycled plastic.

12. The ventilation baffle skirt of claim 1, wherein a first ventilation baffle skirt is configured to nest above a second ventilation baffle skirt such that when the first ventilation baffle skirt is laid above the second ventilation baffle skirt, the two or more truss slots of the first ventilation baffle skirt are overlaid onto the two or more truss slots of the second ventilation baffle skirt and edges of the first ventilation baffle skirt align with edges of the second ventilation baffle skirt.

13. The ventilation baffle skirt of claim 12, wherein a first truss slot of the two or more truss slots is located a first edge distance from a first end of the sheet of material and a last truss slot of the two or more truss slots is located a second edge distance from a second end of the sheet, the first edge distance being equal to the second edge distance.

14. A system comprising:

a ventilation baffle; and a ventilation baffle skirt comprising a sheet material, the ventilation baffle skirt having two or more truss overhang/slot assemblies which complement two or more truss channels of the ventilation baffle;

wherein a truss overhang/slot assembly is defined by a combination of a truss slot and a truss overhang, wherein the truss overhang is connected to a corresponding truss slot at a top portion located within a top side of the sheet material, wherein each overhang/slot assembly has a first height and a portion of the sheet material between two overhang/slot assemblies has a second height that is less than the first height such that between the two overhang/slot assemblies the top portion is spaced from the top side of the sheet material.

15. The system of claim 14, wherein the system is configured to partially define an enclosed area when installed on two or more roof trusses of a structure.

16. The system of claim 15, wherein the two or more truss overhang/slot assemblies of the ventilation baffle skirt are regularly spaced apart at an interval of either one half or one third that of the interval between the two or more roof trusses.

17. The system of claim 15, wherein the enclosed area is further bounded by a ceiling of a structure when the system is installed on the two or more roof trusses such that the ventilation baffle and the ceiling make up opposite sides of the enclosed area.

18. The system of claim 17, wherein the enclosed area is beneath an air gap, the air gap defined by a roof decking, the ventilation baffle, and the two or more roof trusses, the air gap having a predetermined depth between the roof decking and the ventilation baffle, and wherein the ventilation baffle skirt is configured to maintain the predetermined depth.

19. The system of claim 15, wherein the ventilation baffle is configured to be installed over the ventilation baffle skirt, the ventilation baffle skirt having one or more truss overhangs.

20. The system of claim 19, wherein: each overhang is adapted to overlay a truss of a structure, and part of one of the two or more truss channels of the ventilation baffle overlays each overhang.

21. The system of claim 20, wherein the ventilation baffle and ventilation baffle skirt are adapted to use a single securing mechanism to be secured to two or more trusses of a structure, such that the single securing mechanism penetrates both the ventilation baffle and the ventilation baffle skirt when in use.

22. A method of making a ventilation baffle skirt, the method comprising:

forming a ventilation baffle skirt having a sheet of material with: two or more truss slots separated by a distance measured from a center of each truss slot, and a plurality of truss overhangs, each of the plurality of truss overhangs connected to one of the two or more truss slots, from a material comprising: a fibrous material; a cardboard material; fiberglass; a plastic; a recycled material; a recycled plastic; a composite material; or a metal material, wherein each of the plurality of truss overhangs is connected to a corresponding one of the two or more truss slots at a top portion located within a top side of the sheet material, wherein each truss overhang has a first height and a portion of the sheet material between two truss overhangs has a second height that is less than the first height such that between the two truss overhangs the top portion is spaced from the top side of the sheet material.

* * * * *